US011708736B1

(12) United States Patent
Mukhles et al.

(10) Patent No.: US 11,708,736 B1
(45) Date of Patent: Jul. 25, 2023

(54) CUTTING WELLHEAD GATE VALVE BY WATER JETTING

(71) Applicant: Saudi Arabian Oil Company, Dhahran (SA)

(72) Inventors: Amro Mukhles, Udhiliyah (SA); Fahmi Aulia, Udhiliyah (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/649,460

(22) Filed: Jan. 31, 2022

(51) Int. Cl.

| | |
|---|---|
| ***E21B 7/18*** | (2006.01) |
| ***E21B 29/08*** | (2006.01) |
| ***E21B 34/02*** | (2006.01) |
| ***E21B 17/20*** | (2006.01) |

(52) U.S. Cl.
CPC ..... *E21B 29/08* (2013.01); *E21B 17/20* (2013.01); *E21B 34/025* (2020.05)

(58) Field of Classification Search
CPC ..... E21B 7/18; E21B 41/0078; E21B 43/114; E21B 29/08
See application file for complete search history.

(56) References Cited

U.S. PATENT DOCUMENTS 2,708,102 A * 5/1955 Freeman, Jr. ..... E21B 7/16 175/54
3,756,106 A 9/1973 Chadwick et al.
4,306,627 A * 12/1981 Cheung ..... E21B 7/18 299/17
4,369,850 A * 1/1983 Barker ..... B26F 3/004 239/102.1
4,534,427 A * 8/1985 Wang ..... B24C 1/04 175/70
4,611,672 A * 9/1986 Holzl ..... E21B 10/61 175/339
4,703,774 A 11/1987 Seehausen et al.
(Continued)

FOREIGN PATENT DOCUMENTS

| | | |
|---|---|---|
| CN | 107740686 | 2/2018 |
| EP | 0988439 | 3/2000 |

(Continued)

OTHER PUBLICATIONS

Meyer, "Summary of Carbon Dioxide Enhanced Oil Recovery (CO2EOR) Injection Well Technology," prepared for the American Petroleum Institute, 2007, 63 pages.

*Primary Examiner* — Kipp C Wallace
(74) *Attorney, Agent, or Firm* — Fish & Richardson P.C.

(57) ABSTRACT

A well tool assembly to cut a wellhead gate valve by water jetting includes a water jetting head lowered into a wellhead tree coupled to a wellbore. The head includes a housing, an orifice plate and a jetting port. The housing defines a tubular region to receive water. The orifice plate is positioned within the tubular region downstream of a first end and upstream of a second end of the housing, and defines an orifice to accelerate a flow rate of the water received at a first flow rate upstream of the orifice plate to a second flow rate, greater than the first, downstream of the plate. At the second flow rate, the water can mill a gate valve within the wellhead. The jetting port is downstream of the orifice plate, and can receive the water at the second flow rate and guide the received water to the gate valve.

16 Claims, 4 Drawing Sheets

(56) References Cited

U.S. PATENT DOCUMENTS

| | | | | |
|---|---|---|---|---|
| 4,739,845 | A * | 4/1988 | Dennis | E21B 10/62 175/393 |
| 4,834,179 | A | 5/1989 | Kokolis et al. | |
| 4,960,176 | A * | 10/1990 | Loegel | B05B 3/00 175/231 |
| 4,982,786 | A | 1/1991 | Jennings, Jr. | |
| 5,078,177 | A | 1/1992 | Tartaglia et al. | |
| 5,273,112 | A | 12/1993 | Schultz | |
| 5,456,315 | A | 10/1995 | Kisman et al. | |
| 6,062,311 | A | 5/2000 | Johnson et al. | |
| 6,189,629 | B1 * | 2/2001 | McLeod | E21B 7/18 175/321 |
| 6,263,984 | B1 * | 7/2001 | Buckman, Sr. | E21B 7/065 175/45 |
| 6,457,528 | B1 | 10/2002 | Staudt | |
| 6,557,629 | B2 | 5/2003 | Wong | |
| 7,201,238 | B2 * | 4/2007 | Marvin | E21B 37/00 175/107 |
| 7,506,690 | B2 | 3/2009 | Kelley | |
| 7,905,251 | B2 | 3/2011 | Flanders et al. | |
| 8,066,063 | B2 | 11/2011 | Donald et al. | |
| 8,215,392 | B2 | 7/2012 | Rao | |
| 8,353,351 | B2 | 1/2013 | Carpenter et al. | |
| 9,376,896 | B2 | 6/2016 | Smith | |
| 9,890,626 | B2 | 2/2018 | Joshari | |
| 10,174,584 | B2 | 1/2019 | Kajaria et al. | |
| 10,577,533 | B2 | 3/2020 | Babcock et al. | |
| 10,745,991 | B2 | 8/2020 | Kajaria et al. | |
| 11,274,503 | B2 | 3/2022 | Dokhon et al. | |
| 2004/0206507 | A1 | 10/2004 | Bunney | |
| 2006/0180306 | A1 | 8/2006 | Stone | |
| 2008/0156077 | A1 | 7/2008 | Flanders et al. | |
| 2009/0277643 | A1 | 11/2009 | Mondelli et al. | |
| 2013/0000898 | A1 | 1/2013 | Boone | |
| 2013/0126152 | A1 | 5/2013 | Banks et al. | |
| 2014/0151065 | A1 | 6/2014 | Stephenson et al. | |
| 2015/0292297 | A1 | 10/2015 | Kajaria et al. | |
| 2016/0201838 | A1 | 7/2016 | Flanders et al. | |
| 2017/0002624 | A1 | 1/2017 | Hess et al. | |
| 2017/0370153 | A1 | 12/2017 | Gahlawat et al. | |
| 2018/0010416 | A1 | 1/2018 | Vander Velde et al. | |
| 2019/0219186 | A1 | 7/2019 | Fink et al. | |
| 2020/0025413 | A1 | 1/2020 | Lopez et al. | |
| 2020/0149654 | A1 | 5/2020 | Cao et al. | |
| 2021/0054697 | A1 | 2/2021 | Dokhon et al. | |
| 2022/0042404 | A1 | 2/2022 | AlKhateeb et al. | |
| 2022/0065069 | A1 | 3/2022 | Aulia | |

FOREIGN PATENT DOCUMENTS

| | | |
|---|---|---|
| GB | 2433115 | 6/2007 |
| GB | 2546100 | 7/2017 |
| WO | WO 2015147806 | 10/2015 |
| WO | WO 2016128752 | 8/2016 |
| WO | WO 2016139498 | 9/2016 |
| WO | WO 2017196955 | 11/2017 |

* cited by examiner

CUTTING WELLHEAD GATE VALVE BY WATER JETTING

TECHNICAL FIELD

This disclosure relates to wellbore operations, and specifically to accessing a wellbore with a stuck valve.

BACKGROUND

Hydrocarbons (for example, oil, gas or combinations of them) entrapped subsurface reservoirs can be produced by wellbores drilled from the surface of the Earth through subterranean zones to access the reservoirs. To perform wellbore operations during drilling and production, a wellhead is installed at the surface. During drilling, the wellhead includes multiple spools, valves and other well tools to provide pressure control. During production, the wellhead additionally includes hangers and other well tools to hang production tubing and to install a Christmas tree to control flow of the production fluid through the wellbore. The Christmas tree is also an assembly of valves, spools, pressure gauges and chokes fitted to the wellhead of a completed well. Sometimes, a well tool, for example, a valve, in a wellhead Christmas tree can malfunction. Unless the malfunction is rectified, the wellbore cannot be accessed.

SUMMARY

This disclosure describes technologies relating to cutting wellhead gate valve by water jetting.

Certain aspects of the subject matter described here can be implemented as a well tool assembly that includes a water jetting head configured to be lowered into a wellhead tree that can be coupled to a wellbore. The water jetting head includes a housing, an orifice plate and a jetting port. The housing defines a tubular region configured to receive water. The orifice plate is positioned within the tubular region downstream of a first end of the housing and upstream of a second end of the housing. The orifice plate defines an orifice configured to accelerate a flow rate of the water received at a first flow rate upstream of the orifice plate to a second flow rate, greater than the first flow rate, downstream of the orifice plate. At the second flow rate, the water can mill a gate valve disposed within the wellhead. The jetting port is downstream of the orifice plate. The jetting port is configured to receive the water at the second flow rate and to guide the received water to the gate valve.

An aspect combinable with any other aspect includes the following features. The water jetting head can mill a pilot hole through the gate valve. A diameter of the pilot hole is equal to a diameter of the water flowed through the jetting port at the second flow rate.

An aspect combinable with any other aspect includes the following features. A rotary drive is coupled to the jetting port. The rotary drive is configured to cause the jetting port to traverse a circumferential path about a longitudinal axis of the housing to mill a circular portion of the gate valve.

An aspect combinable with any other aspect includes the following features. The housing includes threading at the first end, which is configured to threadedly couple the water jetting head to the coil tubing.

An aspect combinable with any other aspect includes the following features. The assembly includes coil tubing.

An aspect combinable with any other aspect includes the following features. The assembly includes a motor that can be coupled to the water jetting head to power a pump to flow the water to the orifice plate at the first flow rate.

An aspect combinable with any other aspect includes the following features. The pump is a positive displacement pump.

An aspect combinable with any other aspect includes the following features. The motor is upstream of the water jetting head.

Certain aspects of the subject matter described here can be implemented as a method. Water is flowed at a first flow rate through a first portion of a tubular region defined between a first end of a housing of a water jetting head and an orifice plate positioned downstream of the first end. The housing has been lowered into a wellhead tree configured to be coupled to a wellbore. The orifice plate includes an orifice. The water is accelerated from the first flow rate to a second flow rate greater than the first flow rate by flowing the water through the orifice in the orifice plate and into a second portion of the tubular region defined between the orifice plate and a second end of the housing downstream of the orifice plate. At the second flow rate, the water can mill steel. The water at the second flow rate is flowed toward a jetting port installed at the second end of the housing. The jetting port guides the water at the second flow rate onto a gate valve installed in the wellhead tree downhole of the housing. The water at the second flow rate cuts the gate valve.

An aspect combinable with any other aspect includes the following features. Using the water at the second flow rate, a pilot hole is milled through the gate valve. A diameter of the pilot hole is equal to a diameter of the water flowed at the second flow rate.

An aspect combinable with any other aspect includes the following features. A rotary drive coupled to the jetting port rotates the jetting port to traverse a circumferential path about a longitudinal axis of the housing.

An aspect combinable with any other aspect includes the following features. Using the water at the second flow rate, a circular portion of the gate valve is milled. A diameter of the circular portion is based on the circumferential path.

An aspect combinable with any other aspect includes the following features. The first end of the housing is threadedly coupled to coil tubing.

An aspect combinable with any other aspect includes the following features. To flow the water at the first flow rate through the first portion of the tubular region, a pump, fluidically coupled to the water jetting head, pumps the water towards the first end of the housing.

An aspect combinable with any other aspect includes the following features. A motor powers the pump.

An aspect combinable with any other aspect includes the following features. The pump is a positive displacement pump.

An aspect combinable with any other aspect includes the following features. The motor is upstream of the housing.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
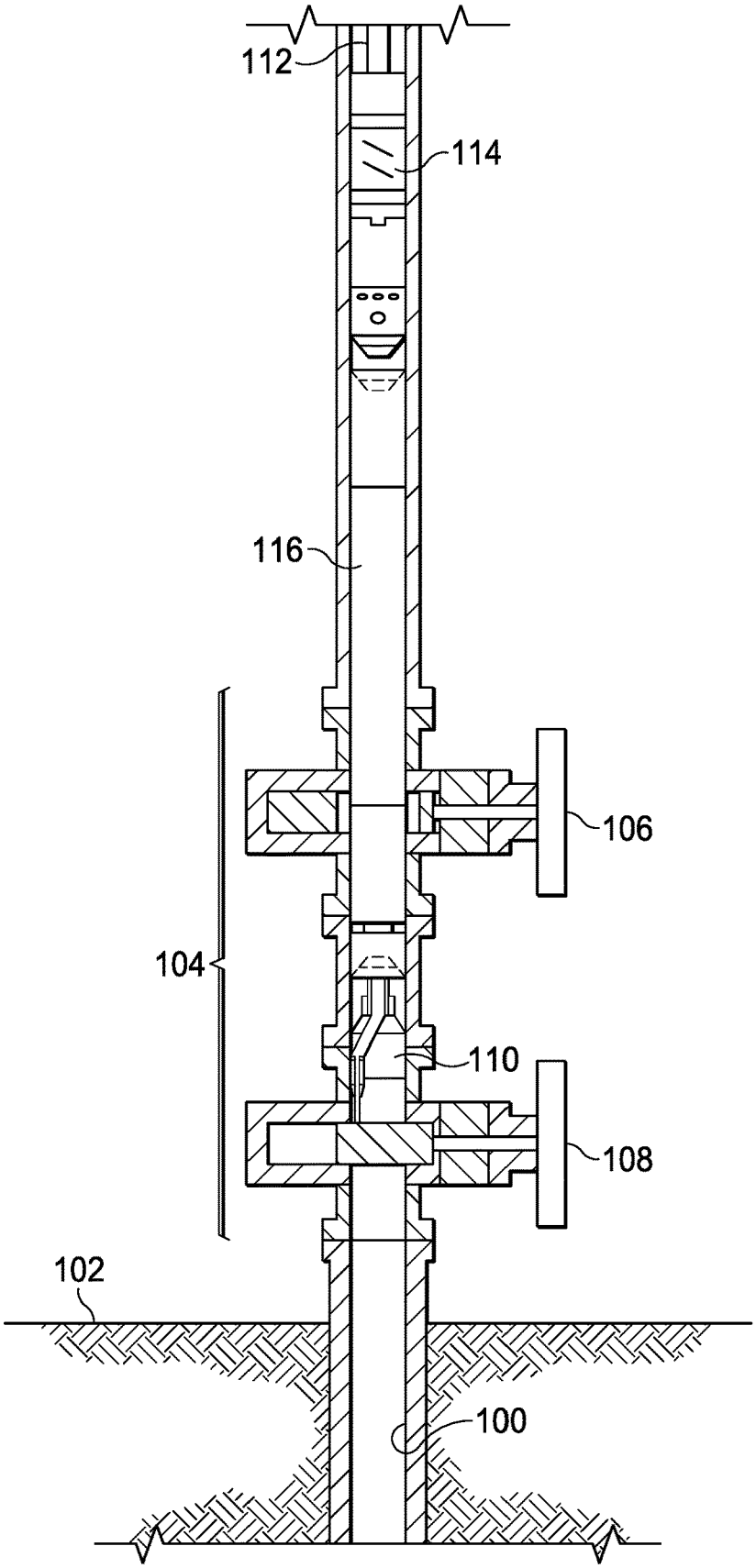
FIG. 1 is a schematic diagram of deploying water jetting to cut a wellhead gate valve.

A wellhead Christmas tree can include gate valves to control flow of hydrocarbon production fluid through a wellbore to which the wellhead is connected. Sometimes, a gate well in the wellhead Christmas tree can get stuck in a closed position. Such a stuck gate valve can pose a serious challenge that restricts options of securing the wellbore ahead of gate valve repair or replacement. In some instances, the stuck valve needs to be removed by milling using wireline or coiled tubing. The milling process can be challenging and time-consuming. Such repair operations also pose safety issues and other complications including the milling tool getting stuck in the stuck gate valve that can lead to a well control incident.

This disclosure describes a method of cutting the stuck wellhead gate valve using water jets in order to regain full wellbore accessibility for well intervention. The water jet can be formed without the use of concentrically arranged coil tubing of different diameters. A water jet can cut through the materials having thickness as high as 12 inches, thereby providing a faster, safer, cleaner option compared to conventional milling using milling bits. In addition, using water jet for milling negates a need for physical contact between a milling tool and the stuck gate valve, thereby increasing safety. Because the water jet can be implemented without using any hazardous chemicals or acids, the techniques described here are also environmentally friendly. Using only water will prevent damage to the wellbore and the reservoir. Implementations of the techniques described here will result in smaller footprint with no mixing requirements negating the need for chemical tanks. Cost savings will also be realized.

Water jetting, i.e., cutting using a high-speed water jet, is also a better and more convenient cutting option compared to laser or plasma cutting. In particular, laser and plasma cutting generate heat that can create hazardous conditions around hydrocarbons in wellbores. Abrasive jetting, i.e., cutting using a slurry of a liquid and abrasives, is used in intervention jobs to create slots or perforations into casing or rock formations. However, the techniques described here use water alone without any sand or other abrasive materials.

Implementations of the subject matter are described in the context of cutting through stuck gate valves in wellhead Christmas trees. The subject matter can similarly be implemented to cut through other malfunctioning components in wellhead Christmas trees or in wellbores that prevent access to regions of the wellbores downhole of the malfunctioning components. Examples of such components include pipes or stuck valves made of steel or similar metal. The jetting technique described here can be implemented in areas other than oil fields such as to cut steel or metal plates in factories that implement machines made of steel or metal plates. Such factories can manufacture components used in industries including aerospace, and automotives. The jetting technique can also be used to cut stone, glass, marble, jewellery and other industries where focused cutting is needed, Also, water is used as an example liquid to form the jet used to cut the stuck gate valve in the wellhead Christmas tree. Other liquids can similarly be used to form the jet, for example, mud brine, or oil-based or synthetic metal cutting fluids. In addition, implementations of the subject matter are described using coiled tubing with a hydraulic activation and providing enough inlet pressure for a water jetting head (described below). Alternatively, the water jetting operation can be deployed by a stand-alone unit.

FIG. 1 is a schematic diagram of deploying water jetting to cut a wellhead gate valve. In some implementations, a wellbore 100 is formed, i.e., drilled, through a subterranean zone (not shown) from a surface 102. A wellhead tree 104 (for example, a wellhead Christmas tree) is installed at the surface 102 at the inlet to the wellbore 100 to control fluid flow through the wellbore 100. The wellhead tree 104 includes multiple flow control components including a first gate valve 106 and a second gate valve 108. As shown in FIG. 1, the first gate valve 106 is open to allow the passage of well tools and the flow of fluids both into and out of the wellbore 100. In contrast, the second gate valve 108 is closed and is stuck in the closed position. As described below, a water jetting head 110 is lowered into the wellhead tree 104 and operated to create a water jet that can cut through the stuck second gate valve 108.

In some implementations, the water jetting head 110 is lowered into the wellhead tree 104 using coiled tubing 112 that carries a bottom hole assembly (BHA) 114. The BHA 114 includes a coiled tubing connector, double check valves, hydraulic disconnect, circulating sub, PDM motor to support the coil tubing operation to deploy, operate and hydraulically power the attached tool underneath it. The water jetting head 110 is coupled to a motor 116 that includes a motor that can power the pump to flow the water to the water jetting head 110. The motor 116 is upstream of the water jetting head 110 when viewed relative to the direction of flow of water toward the water jetting head 110. Details of forming the water jet and using the jet to cut the stuck first gate valve 108 are described with reference to FIGS. 2 and 3.

Figure 2:
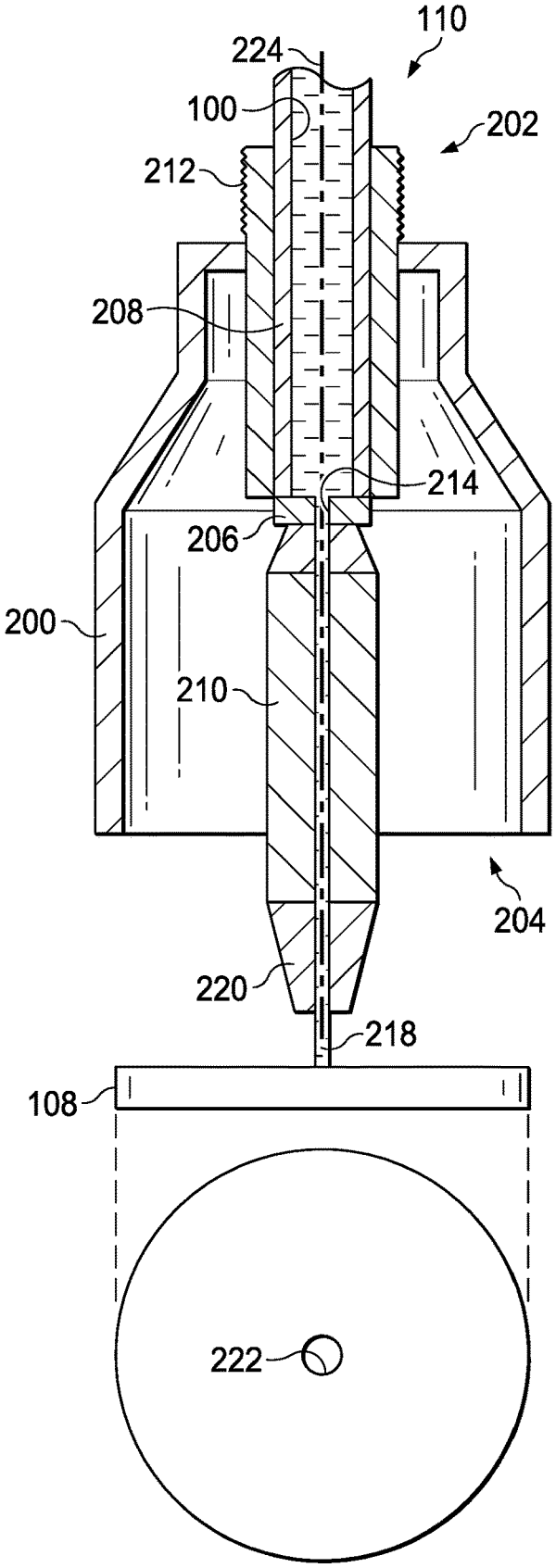
FIG. 2 is a schematic diagram of cutting a pilot hole in a wellhead gate valve with a water jet.

FIG. 2 is a schematic diagram of cutting a pilot hole in a wellhead gate valve with a water jet. In some implementations, the water jetting head 110 includes a housing 200 that defines tubular regions to receive and flow water. The housing 200 includes a first end 202 and a second end 204. The housing 200 defines a hollow, tubular region between the first end 202 and the second end 204. An orifice plate 206 is positioned within the tubular region downstream of the first end 202 and upstream of the second end 204. The position of the orifice plate 206 within the housing 200 divides the tubular region into two portions—a first tubular region 208 between the first end 202 and the orifice plate 206, and a second tubular region 210 between the orifice plate 206 and the second end 204. In some implementations, the housing 200 includes threading 212 at the first end 202. The threading 212 can threadedly couple the water jetting head 110 to coil tubing 112 (FIG. 1). In addition, the water jetting head includes a jetting port 220 downstream of the orifice plate 206. The jetting port 220 receives and guides the water jet onto the stuck gate valve 108. In some implementations, the orifice plate 206 can be placed as close to the jetting port 220 as practically possible to ensure close distance to the object, thereby maximizing the jetting impact and reducing energy losses.

In operation, the first end 202 of the housing 200 is threaded to an end of the coiled tubing 112, and the housing 200 is lowered into the wellhead Christmas tree 104. The motor 116 (FIG. 1) flows water (for example, water at the surface) through the coiled tubing 112 (FIG. 1) into the water jetting head 110, specifically through the first tubular region 208 towards the orifice plate 206 at a first flow rate, for example, at a pressure range of 2000-3000 pounds per square inch (psi). The orifice plate 206 defines an orifice 216 (for example, a through hole extending the thickness of the orifice plate 206 and that has a circular or other cross-section) that accelerates a flow rate of the water received at the first flow rate upstream of the orifice plate 206 to a second flow rate, greater than the first flow rate, downstream of the orifice plate 206. The orifice diameter can range between 0.005 inches and 0.010 inches. The tubular region above the orifice plate 206 can have a diameter of approximately 1.5 inches. At the second flow rate, the water forms a water jet 218 that has a flow velocity large enough to cut the stuck gate valve 108 downstream of the water jetting head 110, for example, at a pressure range of 50,000-60,000 psi. The water jet 218 flows from the orifice plate 206 to the jetting port 220. When the water jetting head 110 is installed in the wellhead tree 104 (FIG. 1), the jetting port 220 is oriented to face the surface of the stuck gate valve 108 that is to be cut. When operated, the water jetting head 110 mills a pilot hole 222 through the stuck gate valve 108.

In the implementation described with reference to FIG. 1, the first tubular region 208 and the second tubular region 210 are coaxial with the longitudinal axis 224 of the housing 200. That is, a longitudinal axis of the first tubular region 208, a longitudinal axis of the second tubular region 210 and the longitudinal axis 224 of the housing 200 are on the same line. In this arrangement, the water upstream of the orifice plate 206 and the water jet 218 downstream of the orifice plate 206 flow along the longitudinal axis 224 of the housing 200. The jetting port 220 is also oriented to be coaxial to the longitudinal axis 224 of the housing 200 allowing the jetting port 220 to receive the water jet 218. Components of the housing 200 are static in this arrangement such that the jetting port 220 cannot move and the water jet cuts the same portion of the gate valve 108 at which the jetting port 220 points.

Figure 3:
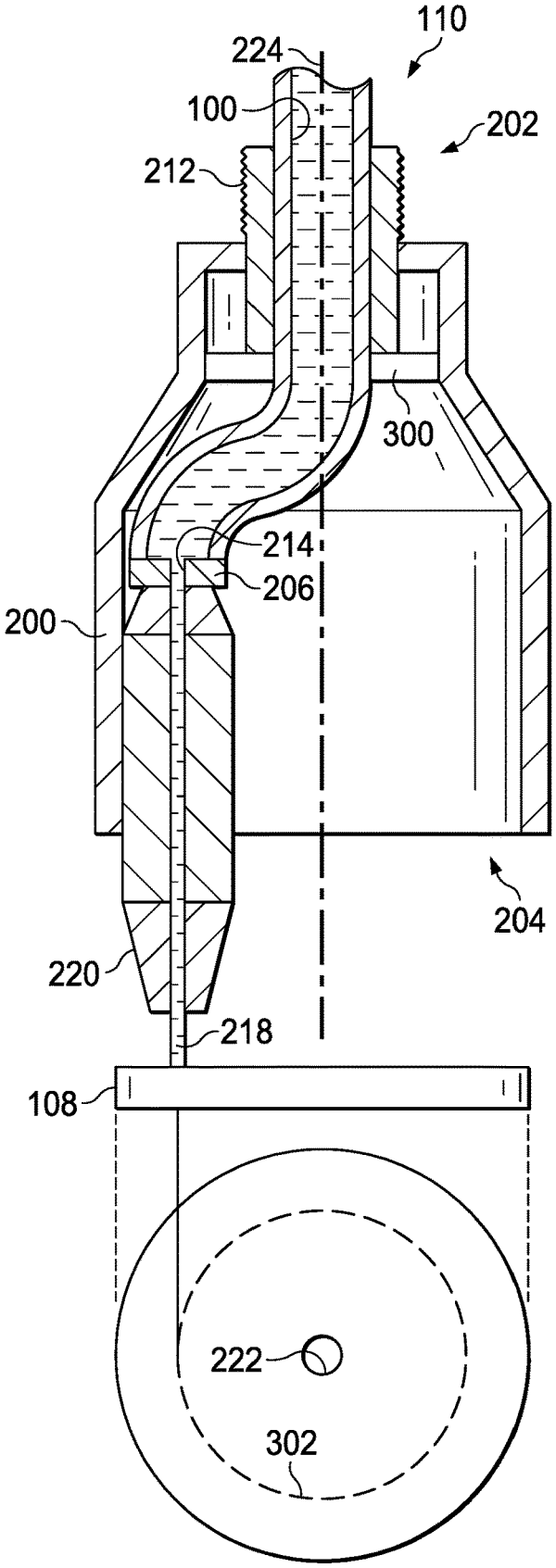
FIG. 3 is a schematic diagram of cutting a circular hole in a wellhead gate valve with a water jet.

FIG. 3 is a schematic diagram of cutting a circular hole in a wellhead gate valve with a water jet. In some implementations, the water jetting head 110 can be used to mill a hole larger than the pilot hole (FIG. 2). In such implementations, the water jetting head 110 includes a rotary drive 300 positioned within the housing 200 and coupled to the jetting port 220. The rotary drive 300 causes the jetting port 220 to traverse a circumferential path 304 about a longitudinal axis 224 of the housing 200. In this arrangement, the jetting port 220 can move. As the jetting port 220 moves, i.e., traverses the circumferential path 304, the water jet impinges upon different portions of the gate valve 108 at which the jetting port 220 points. At the bottom of the motor 116, there is a rotating sub that can be rotated by 360 degrees whenever the motor 116 is activated. This sub rotates the water jetting head 110. In some implementations, the rotary head 300 can allow cutting holes 302 ranging between 2 inches and 3.5 inches in diameter. The diameter of the hole 302 can depend on the circumferential path traversed by the jetting port 220. That is, to cut larger holes 302, the jetting port 220 can traverse circumferential paths of larger diameters compared to circumferential paths of smaller diameters to cut smaller holes 302.

Figure 4:
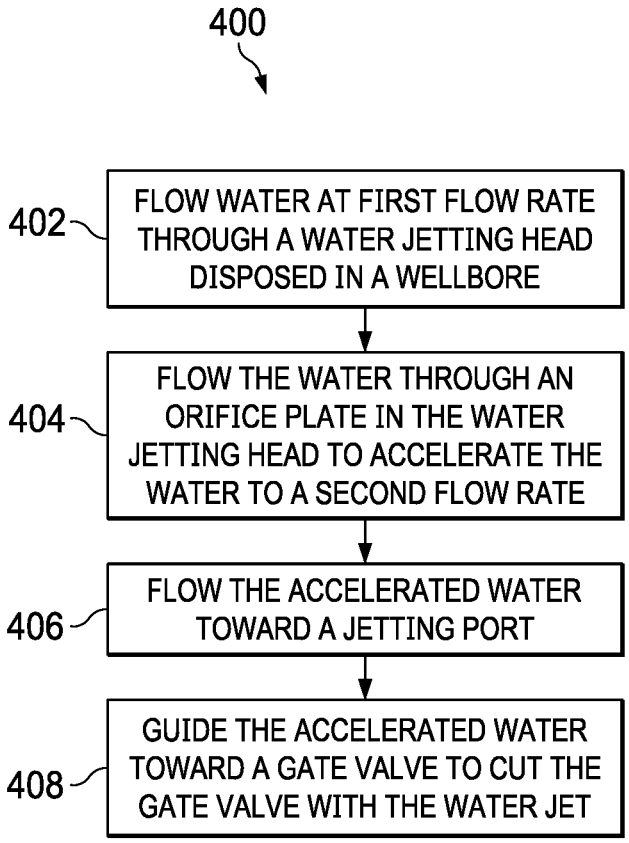
FIG. 4 is a flowchart of an example of a process of deploying water jetting to cut a wellhead gate valve.

FIG. 4 is a flowchart of an example of a process 400 of deploying water jetting to cut a wellhead gate valve. Some or all of the steps of the process 400 can be implemented by the water jetting head 110. At 402, water at a first flow rate through a first portion (for example, the first tubular region 208) of a tubular region defined between a first end (for example, the first end 202) of a housing (for example, housing 200) of a water jetting head (for example, water jetting head 110) lowered into a wellhead tree (for example, wellhead tree 104) configured to be coupled to a wellbore (for example, wellbore 102) and an orifice plate (for example, orifice plate 206) positioned downstream of the first end. The orifice plate defines an orifice (for example, orifice 214).

At 404, water is flowed through the orifice plate in the water jetting head to accelerate the water from a first flow rate upstream of the orifice plate to a second flow rate downstream of the orifice plate. A diameter of the orifice in the orifice plate, dimensions of the tubular region upstream of the orifice plate and a pressure of the water flowed at the first rate are selected such that when the water is accelerated to the second flow rate, the flow velocity of the water is sufficient to cut through steel or other material with which a stuck gate valve or other malfunctioning component of the wellhead tree 104 is made.

At 406, the accelerated water is flowed toward a jetting port (for example, jetting port 220). At 408, the accelerated water is guided toward a surface. For example, the water jet (i.e., the water at the second flow rate) is guided by the jetting port to impinge onto a surface that needs to be cut such as the stuck first gate valve 108 or other malfunctioning component of the wellhead tree 104. The cut piece will drop into the well rat hole and need not be fished or recovered to the surface. The gate valve 108 can then be bullheaded from above and pushed into the wellbore.

Thus, particular implementations of the subject matter have been described. Other implementations are within the scope of the following claims.

The invention claimed is:

1. A well tool assembly comprising:

a water jetting head configured to be lowered into a wellhead tree configured to be coupled to a wellbore, the water jetting head comprising:

a housing defining a tubular region configured to receive water, an orifice plate positioned within the tubular region downstream of a first end of the housing and upstream of a second end of the housing, the orifice plate defining an orifice configured to accelerate a flow rate of the water received at a first flow rate upstream of the orifice plate to a second flow rate, greater than the first flow rate, downstream of the orifice plate, wherein, at the second flow rate, the water is configured to mill a gate valve disposed within the wellhead tree, a jetting port downstream of the orifice plate, the jetting port configured to receive the water at the second flow rate and to guide the received water to the gate valve, and a rotary drive coupled to the jetting port, the rotary drive configured to cause the orifice plate and the jetting port to traverse a circumferential path about a longitudinal axis of the housing to mill a circular portion of the gate valve, wherein the orifice plate rotates relative to the housing as the circumferential path is traversed.

2. The assembly of claim 1, wherein the water jetting head is configured to mill a pilot hole through the gate valve, wherein a diameter of the pilot hole is equal to a diameter of the water flowed through the jetting port at the second flow rate.

3. The assembly of claim 1, wherein the housing comprises threading at the first end, the threading configured to threadedly couple the water jetting head to coil tubing.

4. The assembly of claim 3, further comprising the coil tubing.

5. The assembly of claim 1, further comprising a motor configured to be coupled to the water jetting head, and to power a pump to flow the water to the orifice plate at the first flow rate.

6. The assembly of claim 5, wherein the pump is a positive displacement pump.

7. The assembly of claim 5, wherein the motor is upstream of the water jetting head.

8. A method comprising:

flowing water at a first flow rate through a first portion of a tubular region defined between a first end of a housing of a water jetting head lowered into a wellhead tree configured to be coupled to a wellbore and an orifice plate positioned downstream of the first end, the orifice plate comprising an orifice;

accelerating the water from the first flow rate to a second flow rate greater than the first flow rate by flowing the water through the orifice in the orifice plate and into a second portion of the tubular region defined between the orifice plate and a second end of the housing downstream of the orifice plate, wherein, at the second flow rate, the water is configured to mill steel; and flowing the water at the second flow rate toward a jetting port installed at the second end of the housing;

guiding, by the jetting port, the water at the second flow rate onto a gate valve installed in the wellhead tree downhole of the housing, wherein the water at the second flow rate cuts the gate valve.

9. The method of claim 8, further comprising milling, using the water at the second flow rate, a pilot hole through the gate valve, wherein a diameter of the pilot hole is equal to a diameter of the water flowed at the second flow rate.

10. The method of claim 8, further comprising rotating, by a rotary drive coupled to the jetting port, the jetting port to traverse a circumferential path about a longitudinal axis of the housing.

11. The method of claim 10, further comprising milling, using the water at the second flow rate, a circular portion of the gate valve, wherein a diameter of the circular portion is based on the circumferential path.

12. The method of claim 8, further comprising threadedly coupling the first end of the housing to coil tubing.

13. The method of claim 8, wherein flowing the water at the first flow rate through the first portion of the tubular region comprises pumping, by a pump fluidically coupled to the water jetting head, the water towards the first end of the housing.

14. The method of claim 13, further comprising powering, by a motor, the pump.

15. The method of claim 14, wherein the pump is a positive displacement pump.

16. The method of claim 1, wherein the motor is upstream of the housing.

* * * * *